United States Patent [19]

Kazuoka et al.

[11] Patent Number: 4,546,737

[45] Date of Patent: Oct. 15, 1985

[54] VALVE-SEAT INSERT FOR INTERNAL COMBUSTION ENGINES

[75] Inventors: Koji Kazuoka; Testuya Suganuma, both of Toyota; Naoki Motooka; Nobuhito Kuroishi, both of Itami, all of Japan

[73] Assignees: Sumitomo Electric Industries, Ltd.; Toyota Motor Corporation, both of Japan

[21] Appl. No.: 626,124

[22] Filed: Jun. 29, 1984

[30] Foreign Application Priority Data

Jul. 1, 1983 [JP] Japan ..... 58-120457
Jul. 1, 1983 [JP] Japan ..... 58-120458

[51] Int. Cl.[4] ..... F01L 3/02

[52] U.S. Cl. ..... 123/188 S; 251/359; 251/368; 75/231

[58] Field of Search ..... 123/188 S, 188 AA; 75/231, 246; 251/368, 359

[56] References Cited

U.S. PATENT DOCUMENTS

| | | | |
|---|---|---|---|
| 3,856,478 | 12/1974 | Iwata et al. | 75/246 |
| 3,982,905 | 9/1976 | Osawa et al. | 75/246 |
| 4,035,159 | 6/1976 | Hashimoto et al. | 75/246 |
| 4,346,684 | 8/1982 | Vossieck | 123/188 S |
| 4,424,953 | 1/1984 | Takagi et al. | 251/359 |

FOREIGN PATENT DOCUMENTS

| | | | |
|---|---|---|---|
| 28407 | 3/1977 | Japan | 75/231 |
| 3654 | 1/1981 | Japan | 75/231 |
| 20146 | 2/1981 | Japan | 75/231 |
| 169750 | 12/1981 | Japan | 75/246 |
| 2016046 | 9/1979 | United Kingdom | 75/231 |

OTHER PUBLICATIONS

Chem. Abs., 55–Ferrous Metals vol. 87:139209q; "Powder Metallurgy Materials for Exhaust Valve Seat Rings Performing with Lead-Free Gasoline," Mod. Dev. Powder Metall.

*Primary Examiner*—Ira S. Lazarus
*Assistant Examiner*—R. S. Bailey
*Attorney, Agent, or Firm*—Wenderoth, Lind & Ponack

[57] ABSTRACT

A valve-seat insert for internal combustion engines comprises a double layered, sintered alloy composed of a valve-seat layer on which a valve is seated, and a base layer integrated with the valve-seat layer and adapted to be seated in a cylinder head of an engine. The valve-seat layer is composed of a sintered alloy of a high heat resistance and a high wear resistance having a composition comprising, by weight, 4 to 8% Co, 0.6 to 1.6% Cr, 4 to 8% Mo, 1 to 3% Ni, 0.3 to 1.5% C, 0.2 to 0.6% Ca, and the balance being substantially Fe, the additives, Co, Cr and Mo being present mainly in a form of a Co-Cr-Mo hard alloy and a hard Fe-Mo alloy dispersed in the Fe matrix. The base layer is composed of a sintered alloy of a higher heat resistance and a higher wear resistance than those of the valve-seat layer and having a composition comprising, by weight, 11 to 15% Cr, 0.4 to 2.0% Mo, 0.05 to 0.3% C, balance substantially Fe. The sintered alloy for the base layer may have a compositions further including 2 to 4% Cu.

4 Claims, 3 Drawing Figures

VALVE-SEAT INSERT FOR INTERNAL COMBUSTION ENGINES

This invention relates to valve-seat inserts for use in internal combustion engines and, more particularly, to valve-seat inserts adapted to be fitted in a cylinder head of diesel engines.

In internal combustion engines, valve seats provided in a cylinder head of an engine are subject to repeated impact loads and exposed to heat cycles of heating and cooling, so that the cylinder head is generally provided with valve-seat inserts to reduce valve-seat wear including pounding, pickup and erosion. Such valve-seat inserts are therefore required to have a high wear resistance not only at room temperature but also at elevated temperatures, a high heat resistance and a high resistance to fatigue caused by repeated impact loadings at elevated temperatures. Also, the inserts are required to have the same coefficient of thermal expansion as the cylinder head of engines. Various materials have been used which include cast iron, low alloyed cast irons, chromium alloys, stainless cast steels, and sintered alloys composed of a dispersion of a hard material and a self-lubricating material in an Fe matrix. Such a material provides a very desirable seat for gasoline engines. However, such a material cannot be used for valve-seat inserts for diesel engines. In the diesel engines which have a different combustion mechanism from the gasoline engines, the inserts are exposed to combustion gases of elevated temperatures so that their temperature rises to about 500° C. at the maximum while that of the gasoline engine is about 100° to 150° C. lower. Under such severe conditions, the valve-seat insert made of the above material yields and falls off from the engine head during a prolonged operation because of its low heat resistance, low creep strength and high radial crushing strength. Also, if the insert has a thermal expansion coefficient different from that of the cylinder head which is usually made of cast iron, the difference of their expansion coefficient causes the interference between the insert and the head to decrease gradually during operation of the engine over a long period. Such problems necessitate the use of a material having not only a high wear resistance and the same thermal expansion coefficient as the head material of diesel engines, but also a higher heat resistance and a higher creep strength. Such requirements may be met to some extent by the use of stellite coated valve-seat inserts. However, the stellite coated inserts are too expensive to use them extensively.

It is therefore an object of the present invention to provide a valve-seat insert for use in internal combustion engines that overcomes the aforesaid disadvantages and fully satisfies the above requirements.

Another object of the present invention is to provide a valve-seat insert for use in internal combustion engines that is inexpensive and has a high heat resistance, a high creep strength and a high radial crushing strength in addition to a high wear resistance.

A further object of the present invention is to provide a valve-seat insert for use in cylinder heads of diesel engines.

These and other objects of the present invention can be achieved by providing a valve-seat insert for internal combustion engines comprising a double layered, sintered alloy composed of a valve-seat layer on which a valve is seated, and a base layer integrated with the valve-seat layer and adapted to be seated in a cylinder head of the engine, said valve-seat layer being composed of a sintered alloy of a high heat resistance and a high wear resistance, said base layer being composed of a sintered alloy of a higher heat resistance and a higher wear resistance than the valve-seat layer.

In the running of diesel engines, the valve seat is exposed to combustion gas at elevated temperatures of about 400° to 500° C. while the cylinder head is cooled by cooling water to keep the same at a low temperature. The cylinder head has a radial crushing strength of about 50 to 60 kgf/mm$^2$ at room temperature, and this strength will be kept in operation. Thus, in order to prevent deterioration with the creep of the valve insert, the valve-seat insert should have a radial crushing strength higher than the cylinder head even at the running temperature of the engine. According to the present invention, it has now been found that the deterioration with creep of valve-seat inserts may be minimized by the use of a sintered alloy having a radial crushing strength not less than 90 kgf/mm$^2$ at room temperature, but not less than 70 kgf/mm$^2$ at 500° C. Also, the use of such a valve-seat insert makes it possible to minimize a decrease of the interference between the valve-seat insert and the head. However, it is difficult with a single layer of a sintered alloy to produce valve-seat inserts with a radial crushing strength of not less than 90 kgf/mm$^2$ at room temperature, but not less than 70 kgf/mm$^2$ at 500° C. To solve this problem, a valve-seat insert of the present invention consists of a double layered, sintered alloy composed of a valve-seat layer and a base layer having a radial crushing strength higher than that of the valve-seat layer. Concretely, the valve-seat insert of the present invention consists of a double layered sintered alloy comprising a base layer with a radial crushing strength of not less than 100 kgf/mm$^2$ at room temperature, but not less than 80 kgf/mm$^2$ at 500° C.

According to the present invention, there is provided a valve-seat insert for internal combustion engines comprising a double layered, sintered alloy composed of a valve-seat layer on which a valve is seated, and a base layer integrated with said valve-seat layer and adapted to be seated in a cylinder head of an engine, said valve-seat layer being composed of a sintered alloy of a high heat resistance and a high wear resistance having a composition comprising, by weight, 4 to 8% Co, 0.6 to 1.5% Cr, 4 to 8% Mo, 1 to 3% Ni, 0.3 to 1.5% C, 0.2 to 0.6% Ca, balance substantially Fe, said Co, Cr and Mo being present mainly in a form of a Co-Cr-Mo hard alloy and a Fe-Mo hard alloy dispersed in the Fe matrix of the valve-seat layer, said base layer being composed of a sintered alloy of a higher heat resistance and a higher wear resistance than those of the valve-seat layer and having a composition comprising, by weight, 11 to 15% Cr, 0.4 to 2.0% Mo, 0.05 to 0.3% C, and the balance substantially Fe.

Also, the above objects of the present invention can be achieved by providing a valve-seat insert for internal combustion engines comprising a double layered, sintered alloy composed of a valve-seat layer on which a valve is seated, and a base layer integrated with said valve-seat layer and adapted to be seated in a cylinder head of the engine, said valve-seat layer being composed of a sintered alloy of a high heat resistance and a high wear resistance, said base layer being composed of a sintered alloy of a higher heat resistance and a higher wear resistance than the valve-seat layer having a dimensional change rate in sintering approximately equal to that of the valve-seat layer.

According to the present invention there is further provided a valve-seat insert for internal combustion engines comprising a double layered, sintered alloy composed of a valve-seat layer on which a valve is seated, and a base layer integrated with said valve-seat layer and adapted to be seated in a cylinder head of an engine, said valve-seat layer being composed of a sintered alloy of a high heat resistance and a high wear resistance having a composition comprising, by weight, 4 to 8% Co, 0.6 to 1.5% Cr, 4 to 8% Mo, 1 to 3% Ni, 0.3 to 1.5% C, 0.2 to 0.6% Ca, and the balance substantially Fe, said Co, Cr and Mo being present mainly in the form of a Co-Cr-Mo hard alloy and a Fe-Mo hard alloy dispersed in the Fe matrix of the valve-seat layer, said base layer being composed of a sintered alloy of a higher heat resistance and a higher wear resistance than the valve-seat layer having a dimensional change rate in sintering approximately equal to that of the valve-seat layer, said sintered alloy for forming the base layer having a composition comprising, by weight, 11 to 15% Cr, 0.4 to 2.0% Mo, 0.05 to 0.3% C, 2 to 4% Cu, and the balance substantially Fe.

The reasons why the composition of the sintered alloy for the valve-seat layer has been limited to the above range are as follows: Co, Cr and Mo are added to an Fe matrix in a form of Co-Cr-Mo hard alloy and a Fe-Mo hard alloy to improve the heat resistance and wear resistance. Most of these alloys are dispered in the matrix and present as a hard phase and improves both the heat resistance and wear resistance, while a part of the addition alloy dissolves in the matrix and contributes to improve the heat resistance and to strengthen the bond between the matrix and the hard phase. If the content of Co is less than 4%, or that of Cr is less than 0.6%, or that of Mo is less than 4%, the addition of these additives takes no recognizable effect. If the contents of these additives exceed the above respective maximum values, i.e., 8% for Co, 1.5% for Cr, and 8% for Mo, the hard phase is present in too great amounts and causes the valve to wear. For these reasons, the content of Co has been limited to the range of 4 to 8%, the content of Cr has been limited to the range of 0.6 to 1.5%, and the content of Mo has been limited to the range of 4 to 8%.

Ni is added to the Fe matrix to strengthen the ferrite and to improve the toughness of the matrix. If the content of Ni is less than 1%, its addition takes no recognizable effects, and if the content exceeds 3%, it causes an increase of residual austenite in the matrix. Accordingly, the content of Ni has been limited within the range of 1 to 3%.

C dissolves in the matrix and forms pearlite to strengthen the matrix and improve the wear resistance. If the content of C is less than 1%, it is not possible to obtain the desired effects. If the content of C is mcre than 1.5%, it causes the sintered alloy to become embrittled. For these reasons, the content of C has been limited to the range of 1 to 3%.

Ca is added to the matrix in the form of $CaF_2$ to improve the self-lubricating properties of the valve-seat layer and to improve resistance to sliding abrasive wear and to improve the machinability. If the content of Ca is less than 0.2%, its addition takes no recognizable effects. If the Ca content exceeds 0.6%, the properties of the alloy are not improved any more and excess Ca causes lowering of the mechanical strength. Thus, the content of Ca has been limited to the range of 0.2 to 0.6%.

The reasons why the composition of the sintered alloy for the base layer have been limited to the above range are as follows: Cr dissolves in the matrix and contributes to strengthen the matrix and to improve the heat resistance. If the content of Cr is less than 11%, it is not possible to obtain the desired effects. The heat resistance increases with the increase of the content of Cr, but it reaches a maximum at a content of 15% and is not improved any more even if the Cr content exceeds 15%. Thus, the Cr content has been limited within the range of 11 to 15%.

Mo, a carbide-forming element, is added to the matrix to strengthen the same and to improve the heat resistance and creep strength. If the Mo content is less than 0.4%, it is not possible to obtain the desired properties. If the Mo content exceeds 2.0%, it cannot improve the properties any more and causes an increase in the manufacturing cost.

C forms carbides with Mo, Fe and Cr and contributes to strengthen the matrix. If the content of C is less than 0.05%, it is not possible to obtain the desired effects and, if the content exceeds 0.3%, it causes embrittlement of the base layer and lowering of its mechanical strength.

Additionally, Cu is further added to the Fe matrix of the base layer, if it is required to produce valve-seat inserts with high dimensional accuracy. Cu dissolves in the Fe matrix and contributes to reduce dimensional changes in sintering of the base layer and to bring its dimensional change rate close to that of the valve-seat layer. If the content of Cu is less than 2%, its addition takes no recognizable effects. If the Cu content exceeds 4%, it causes lowering of mechanical strength. Thus, the content of Cu has been limited to the range of 2 to 4%.

In the preferred embodiment, the valve-seat insert comprises a valve-seat layer of a sintered alloy having a density of not less than 6.8 $g/cm^3$, and a base layer of a sintered alloy having a density of not less than 6.6 $g/cm^3$. Because, if the densities of these layers are less than the above respective minimum values, it is difficult to produce a valve-seat insert having a desired mechanical strength and a desired resistance to repeated shock loads. The reason why the density of two layers differ from each other is that the density of sintered alloy is sensitive to changes in compositions and compression properties of the powder materials. Preferably, the valve-seat and base layers are so formed that the valve-seat layer has a thickness approximately equal to that of the base layer. If the thickness of the valve-seat layer is too thin, it is difficult to produce valve-seat inserts with a high wear resistance, and if the thickness of the base layer, it is difficult to produce valve-seat inserts with a high heat resistance and a high creep strength. However, the ratio of the thickness between the valve-seat layer and the base layer may be varied to any ratio, if desired.

The valve-seat insert according to the present invention may be produced by a process comprising the steps of separately preparing a mixture of raw materials for the valve-seat layer and a mixture of raw materials for the base layer, pre-compacting the mixture for the base layer, compacting the same together with the mixture for the valve-seat layer to form a double layered green compact, and then sintering the green compact in a neutral or reducing atmosphere.

According to the present invention, it is possible to produce a valve-seat insert having a high wear resistance not only at room temperature but also at elevated temperatures, a high heat resistance and a high resistance to fatigue caused by repeated impact loadings at elevated temperatures. Also, it is possible to obtain valve-seat inserts having a radial crushing strength of not less than 90 kgf/mm$^2$ at room temperature, but not less than 70 kgf/mm$^2$ at 500° C. Further, it is possible to obtain valve-seat inserts consisting of a double-layered sintered alloy comprising a base layer with a radial crushing strength of not less than 100 kgf/mm$^2$ at room temperature, but not less than 80 kgf/mm$^2$ at 500° C.

The invention will be further apparent from the following description with reference to examples thereof.

BRIEF DESCRIPTION OF THE DRAWINGS

Referring now to FIG. 1, there is shown a valve-seat insert according to the present invention. The valve-seat insert 1 is pressed in a cylinder head 4 of a diesel engine and subjected to a valve-spring force when a valve 5 is seated. The valve-seat insert 1 consists of a double layered, sintered alloy comprising a valve-seat layer 2 and a base layer 3 which have been integrated by sintering.

EXAMPLE 1

Using powders of an Fe-Cr alloy (13wt % Cr), atomized iron, Co, Mo(or $Mo_2C$), Ni, a Co-Cr-Mo alloy (Co-30% Mo-10% Cr), graphite, ferromolybdenum, Cu and $CaF_2$ as raw materials, there were prepared powder mixtures for the valve-seat and base layers each having a composition shown in Table 1. Minus sieves of 100 mesh screens were used for powders of the Fe-Cr alloy, atomized iron, Co, Mo(or $Mo_2C$), Ni, Co-Cr-Mo alloy, graphite, Cu and $CaF_2$, while a minus sieve of a 200 mesh screen was used for powder of ferromolybdenum. The resultant mixture for the base layer was pre-compacted, and then compacted together with the mixture for the valve-seat layer under a pressure of 6.5 t/cm$^2$ to prepare green compacts with dimensions of 37 mm (outside diameter)×30 mm (inside diameter)×6 mm(thickness). The resultant green compacts were sintered in a neutral or reducing atmosphere at 1200° C. for 30 minutes to produce valve-seat insert rings consisting of a double layered, sintered alloy.

Figure 1:
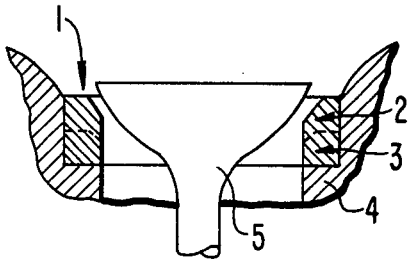
FIG. 1 is a schematic sectional view of a valve-seat insert according to the present invention, pressed in a cylinder head of diesel engine.

The thus produced valve-seat inserts were subjected to durability tests on the diesel engine. The inserts were pressed in a cylinder head of a diesel engine (4 cylinders, 2000 cc) under the initial interference of 80 microns, as shown in FIG.1. The engine was run at 4000 rpm for 400 hours. After 400 hours running, a load required for ejecting the insert from the head was measured to determine the heat resistance and creep strength of the insert. The results are also shown in Table 1.

TABLE 1

| No. | Composition of valve-seat layer (weight %) | Composition of base layer (weight %) | Ejecting Load (kg) |
|---|---|---|---|
| 1 | Fe—2 Ni—5 Co—1 Cr—6 Mo—0.8 C—0.4 Ca | Fe—13 Cr—0.9 Mo—0.1 C | 520 |
| 2 | " | Fe—11 Cr—0.6 Mo—0.05 C | 490 |
| 3 | Fe—2 Ni—5 Co—1 Cr—6 Mo—0.8 C—0.4 Ca | Fe—13 Cr—0.9 Mo—0.1 C—3 Cu | 490 |
| 4 | " | Fe—11 Cr—0.6 Mo—0.05 C—2 Cu | 470 |
| 5 | " | Fe—12 Cr—0.1 C | 420 |
| 6 | " | Fe—3 Cu—1 C | 340 |
| 7 | " | — | 400 |

From the results shown in Table 1, it will be seen that the valve-seat inserts Nos. 1 to 4 according to the present invention have a high ejecting load as compared with the comparative examples Nos. 5, 6 and 7. Also, the requirements for the characteristics of the valve-seat inserts for the diesel engines are fully met by the the valve-seat inserts according to the present invention that have a high heat resistance and a high creep strength.

To determine the radial crushing strength of the sintered alloys for the valve-seat and base layers, there were prepared sintered alloy rings in the following manner. The aforesaid raw materials were weighed and mixed to prepare mixtures each having a compositional proportion shown in Table 2. The resultant mixture was shaped into rings having dimensions 40 mm (outside diameter)×27 mm (inside diameter)×10 mm (thickness) under a pressure of 6.5 t/cm$^2$ and then sintered at 1200° C. for 30 minutes in a neutral or reducing atmosphere to prepare sintered alloy rings. The resultant specimens were subjected to measurement of the radial crushing strength both at room temperature and at an elevated temperature of 500° C. The results are shown in Table 2.

In Table 2, specimens Nos. 1 to 8 are those having a composition used for the base layer of the valve-seat inserts according to the present invention, and a specimen No. 12 is the one having a composition used for the valve-seat layer of the valve-seat inserts according to the present invention. Specimens Nos. 9 to 11 are composed of comparative sintered alloys.

TABLE 2

| Specimen No. | composition (weight %) | Radial crushing strength (kgf/mm$^2$) Room Temp | At 500° C. |
|---|---|---|---|
| 1 | Fe—11 Cr—0.6 Mo—0.05 C | 118 | 89 |
| 2 | Fe—12 Cr—0.9 Mo—0.1 C | 124 | 106 |
| 3 | Fe—13 Cr—0.9 Mo—0.3 C | 107 | 105 |
| 4 | Fe—12 Cr—1.2 Mo—0.1 C | 121 | 115 |
| 5 | Fe—11 Cr—0.6 Mo—0.05 C—2 Cu | 100 | 86 |
| 6 | Fe—12 Cr—0.9 Mo—0.1 C—3 Cu | 120 | 101 |
| 7 | Fe—13 Cr—0.9 Mo—0.3 C—4 Cu | 102 | 98 |
| 8 | Fe—12 Cr—1.2 Mo—0.1 C—3 Cu | 117 | 111 |
| 9 | Fe—12 Cr—0.9 Mo—0.5 C | 92 | 90 |
| 10 | Fe—12 Cr—0.3 Mo—0.1 C | 110 | 75 |
| 11 | Fe—3 Cu—1 C | 68 | 49 |
| 12 | Fe—2 Ni—5 Co—1 Cr—6 Mo—0.8 C—0.4 Ca | 94 | 79 |

From the results shown in Table 2, it will be seen that the sintered alloys used in the present invention have a higher strength and a high heat resistance than the comparative sintered alloys.

EXAMPLE 2

Using raw materials in Example 1, there were prepared a mixture for the valve-seat layer having a composition of Fe-2Ni-5Co-1Cr-6Mo-0.9C-0.4Ca, and mixtures for the base layer each having a composition shown in Table 3. Each of the resultant mixtures for the base layer was pre-compacted, and then compacted together with the mixture for the valve-seat layer under a pressure of 6.5 t/cm$^2$ to prepare double layered green compacts of 40 mm in outside diameter, 27 mm in inside diameter, and 8 mm in thick. The thickness of each layer was adjusted to 4 mm so that the boundary plane between the two layers was placed at a center of the opposed surfaces of the green compact. The resultant green compacts were sintered in a non-oxidizing atmosphere at 1200° C. for 30 minutes to produce valve-seat insert rings consisting of a double layered, sintered alloy.

TABLE 3

| | Composition of Base Layer (wt%) |
|---|---|
| 13 | Fe—12 Cr—0.9 Mo—0.1 C |
| 14 | Fe—12 Cr—0.9 Mo—0.1 C—1 Cu |
| 15 | Fe—12 Cr—0.9 Mo—0.1 C—5 Cu |
| 16 | Fe—12 Cr—0.9 Mo—0.1 C—2 Cu |
| 17 | Fe—12 Cr—0.9 Mo—0.1 C—3 Cu |
| 18 | Fe—12 Cr—0.9 Mo—0.1 C—4 Cu |

Figure 2:
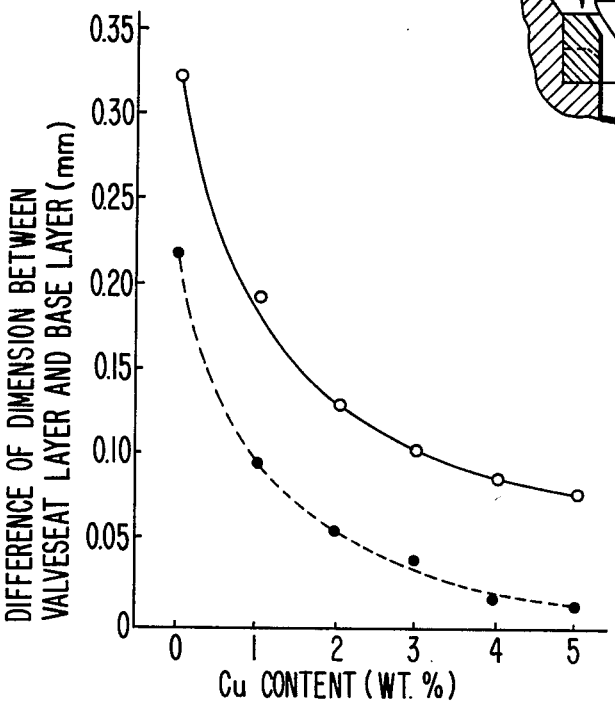
FIG. 2 is a graph showing differences of inter and outer diameters between the valve-seat layer and the base layer as a function of a Cu content.

Each of the thus produced valve-seat inserts was subjected to measurements of inside and outside diameters for the respective layers of the insert. The measurement was taken at a point 1 mm apart from the each surface of the opposed valve-seat and base layer. A difference of the outside or inside diameter between the valve-seat layer and the base layer was determined for each insert. The results are shown in FIG. 2. In this figure, a solid line shows the results for the outside diameters, and a broken line shows the results for the inside diameters.

Figure 3:
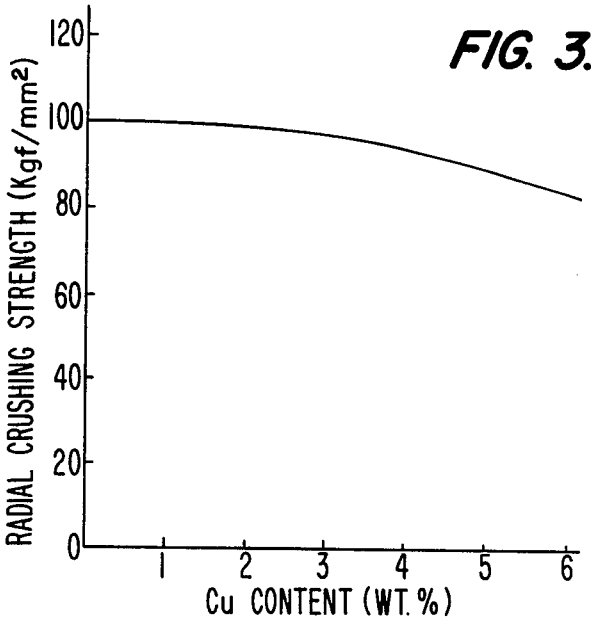
FIG. 3 is a graph showing relationship between a radial crushing strength and a Cu content.

Each valve-seat insert was then ground to 39 mm in outside diameter and 26 mm in inside diameter and then subjected to measurement of the radial crushing strength at room temperature. The results are shown in FIG. 3. In this figure, the results of the radial crushing strength are plotted as a function of the Cu content.

From the results shown in FIGS. 2 and 3, it will be seen that the addition of Cu into the Fe matrix of the base layer makes it possible to reduce dimensional changes in the sintering of the base layer without lowering the radial crushing strength.

What we claim is:

1. A valve-seat insert for internal combustion engines comprising a double layered, sintered alloy composed of a valve-seat layer on which a valve is seated, and a base layer integrated with the valve-seat layer and adapted to be seated in a cylinder head of the engine, said valve-seat layer being composed of a sintered alloy of a high heat resistance and a high wear resistance, said base layer being composed of a sintered alloy having a radial crushing strength which is higher than that of the valve-seat layer and not less than 100 kgf/mm$^2$ at room temperature, but not less than 80 kgf/mm$^2$ at 500° C., said sintered alloy of the base layer comprising, by weight, 11 to 15% or Cr, 0.4 to 2.0% of Mo, 0.05 to 0.3% of C, and the balance being substantially Fe.

2. A valve-seat insert according to claim 1, wherein the sintered alloy of said base layer further comprises 2 to 4% of Cu.

3. A valve-seat insert according to claim 1, wherein the sintered alloy of said valve-seat layer comprises, by weight, 4 to 8% of Co, 0.6 to 1.5% of Cr, 4 to 8% of Mo, 1 to 3% of Ni, 0.3 to 1.5% of C, 0.2 to 0.6% of Ca, and the balance substantially Fe, said Co, Cr and Mo being present mainly in a form of a Co-Cr-Mo hard alloy and a Fe-Mo hard alloy dispersed in the Fe matrix of the valve-seat layer.

4. A valve-seat insert for internal combustion engines comprising a double layered, sintered alloy composed of a valve-seat layer on which a valve is seated, and a base layer intergrated with said valve-seat layer and adapted to be seated in a cylinder head of an engine, said valve-seat layer being composed of a sintered alloy of a high heat resistance and a high wear resistance, the sintered alloy of said valve-seat layer consisting esstentially of, by weight, 4 to 8% Co, 0.6 to 1.5% Cr, 4 to 8% Mo, 1 to 3% Ni, 0.3 to 1.5% C, 0.2 to 0.6% Ca, and the balance substantially Fe, said Co, Cr and Mo being present mainly in a form of a Co-Cr-Mo hard alloy and a Fe-Mo hard alloy dispersed in the Fe matrix of the valve-seat layer, said base layer being composed of a sintered alloy having a radial crushing strength which is higher than that of the valve-seat layer and not less than 100 kgf/mm$^2$ at room temperature, but not less than 80 kgf/mm$^2$ at 500° C., the sintered alloy of said base layer consisting essentially of, by weight, 11 to 15% Cr, 0.4 to 2.0% Mo, 0.05 to 0.3% C and the balance consisting substantially of Fe.

* * * * *